US005080018A

United States Patent [19]

Reuter

[11] Patent Number: 5,080,018

[45] Date of Patent: Jan. 14, 1992

[54] CARTRIDGE FOR EXPELLING FLUIDS UNDER PRESSURE

[75] Inventor: Ingolf Reuter, Dornhan, Fed. Rep. of Germany

[73] Assignee: Mauser-Werke Oberndorf GmbH, Oberndorf, Fed. Rep. of Germany

[21] Appl. No.: 564,040

[22] Filed: Aug. 7, 1990

[30] Foreign Application Priority Data

Aug. 7, 1989 [DE] Fed. Rep. of Germany ..... 3926051

[51] Int. Cl.[5] ..... F42B 3/04

[52] U.S. Cl. ..... 102/439; 102/517

[58] Field of Search ..... 102/430, 439, 440, 517

[56] References Cited

U.S. PATENT DOCUMENTS

| | | | |
|---|---|---|---|
| 692,819 | 2/1902 | Bissell | 102/440 |
| 802,301 | 10/1905 | Michele | 102/430 |
| 3,313,208 | 4/1967 | Dorsey, Jr. et al. | 102/440 |
| 3,649,020 | 3/1972 | Hall | 102/439 |
| 3,732,821 | 5/1973 | Royer | 102/517 |
| 4,779,535 | 10/1988 | Maki | 102/439 |
| 4,909,152 | 3/1990 | Reuter | 102/430 |
| 4,941,390 | 7/1990 | Bulman | 102/440 |

FOREIGN PATENT DOCUMENTS

| | | |
|---|---|---|
| 3631249 | 3/1988 | Fed. Rep. of Germany . |
| 3726490 | 2/1989 | Fed. Rep. of Germany . |

*Primary Examiner*—Deborah L. Kyle
*Assistant Examiner*—Richard W. Wendtland
*Attorney, Agent, or Firm*—McGlew & Tuttle

[57] ABSTRACT

A cartridge 1 for expelling fluids under pressure has a drive body 5 as a cartridge case base 4, which is a hollow cylinder and has a rear opening toward the fluid chamber 2. The front end face of the drive body 5 has a spherical constricted area 10 with cylindrical projection, which receives a closing member 6 in a force-locking manner.

12 Claims, 2 Drawing Sheets

CARTRIDGE FOR EXPELLING FLUIDS UNDER PRESSURE

FIELD OF THE INVENTION

The present invention pertains generally to a cartridge for expelling fluids under pressure, comprising a propellant charge chamber and a separating device, arranged between the propellant charge chamber and a fluid chamber, and more particularly to a separating device which is designed as a cartridge case base including a drive body and a closing member arranged on a front side.

BACKGROUND OF THE INVENTION

Such a cartridge for expelling fluids under pressure has been known from DE 37,26,490 CZ. In this prior-art cartridge, the drive body is connected to the closing member by a central pin in a positive-locking or force-locking manner, and the closing member either is designed as a hollow body with an essentially spherical end face or is made of plastic, preferably a polyurethane foam.

SUMMARY AND OBJECTS OF THE INVENTION

It is an object of the present invention to provide a cartridge of the type mentioned in the introduction, in which the drive body has improved strength properties and seals itself off within the barrel of the weapon.

In accordance with the present invention the drive body as is designed as a hollow cylindrical body made of an elastically deformable material with a constricted section at its front end. The constricted section is open toward the rear propellant charge chamber, where said constricted section ends in a spherical or ball-like shape in one piece and receives the elastically deformable closing member.

According to the design of the present invention, the closing member may be made of a plastic, preferably a polyurethane foam.

Furthermore, the outer jacket surface of the drive body may form, together with the closing member in the barrel of the weapon, a fluid chamber whose volume can be increased and which corresponds to an essentially radial inlet opening in the barrel of the weapon. The drive body may be designed such that it can be axially separated from the closing member in the barrel of the weapon by the pressure of the fluid flowing into the fluid chamber.

The particular shape of the drive body, a hollow cylindrical body which is open toward the rear propellant charge chamber and which consists of an elastically deformable material, has the advantage that the gases generated on ignition of the powdered propellant charge build up a gas pressure within the drive body. This pressure sealingly presses the jacket surface of the drive body against the inner wall of the barrel of the weapon. Due to this shape, the drive body has two guide diameters. This arrangement permits firing from barrels with a tapering diameter. The rear jacket surface, having the caliber size, guides the drive body in the cylindrical part of the barrel. The rear part of the drive body is correspondingly compressed in the adjoining barrel section, in which the internal diameter continuously decreases. The front guide diameter will then assume the centering and guiding function in the narrower muzzle area of the barrel.

The front-end constricted section of the drive body, which ends in a front, spherical form in one piece, leads to improved strength properties of the drive body. The gas pressure generated, optimally occurs axially in the hollow cylindrical drive body and propels the water column in the outer fluid chamber in the forward direction. The spherical constricted front section causes the front closing member to become readily detached from the spherical constricted section of the drive body under the fluid pressure generated. The drive body itself moves the water column forward constantly and at high speed under the gas pressure generated, without itself becoming damaged, while being sealed at its outer jacket surface, and adapting itself to the variable internal diameter of the barrel.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DETAILED DESCRIPTION OF THE PREFERRED EMBODIMENT

Figure 2:
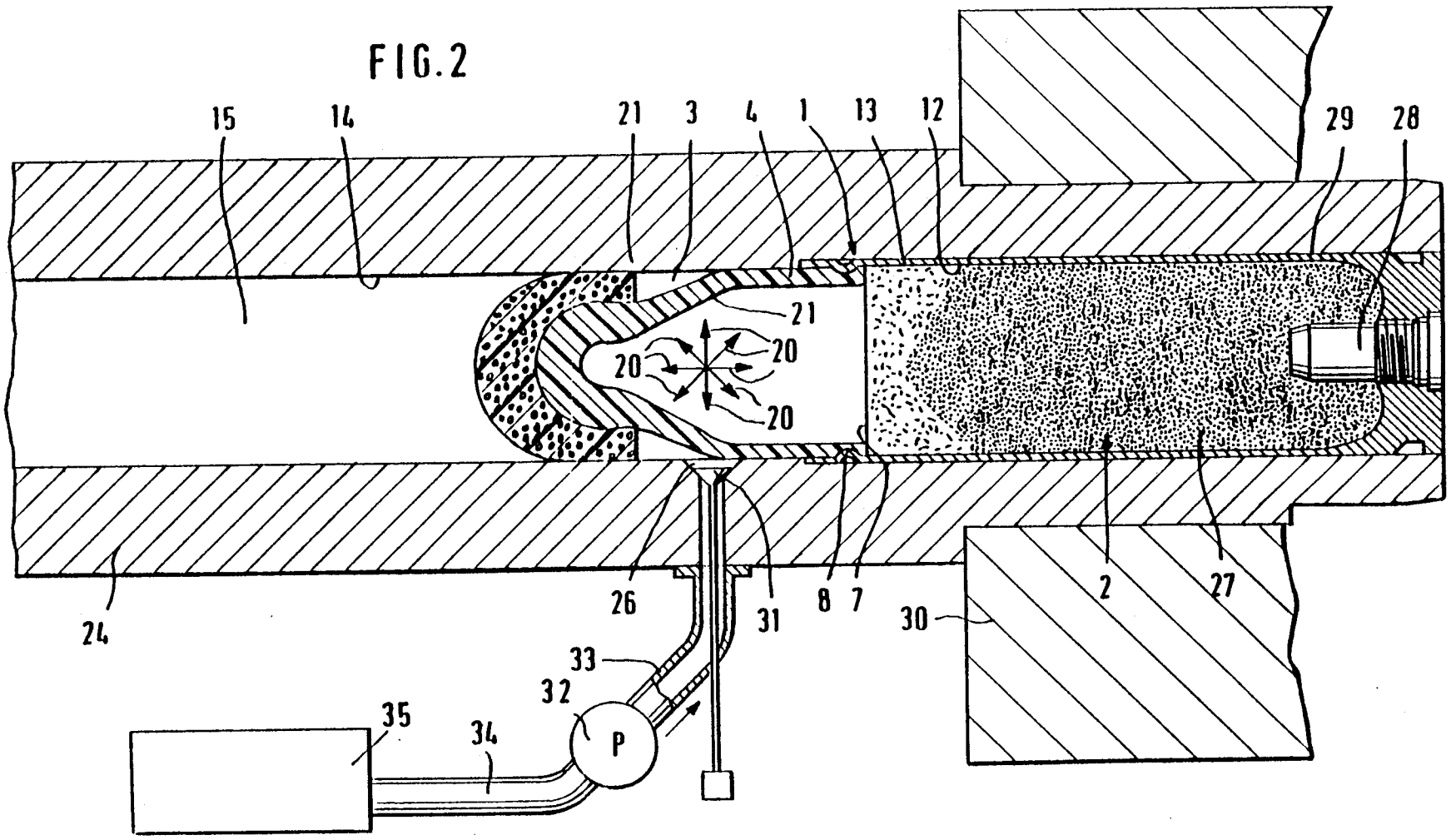

Referring to the drawings and in particular to FIG. 2, a cartridge 1 for expelling fluids, especially water, under pressure, is provided with a cartridge case base 4. The cartridge case base 4 is inserted as a separating device between a propellant charge chamber 2 and a fluid chamber 3.

Figure 1:
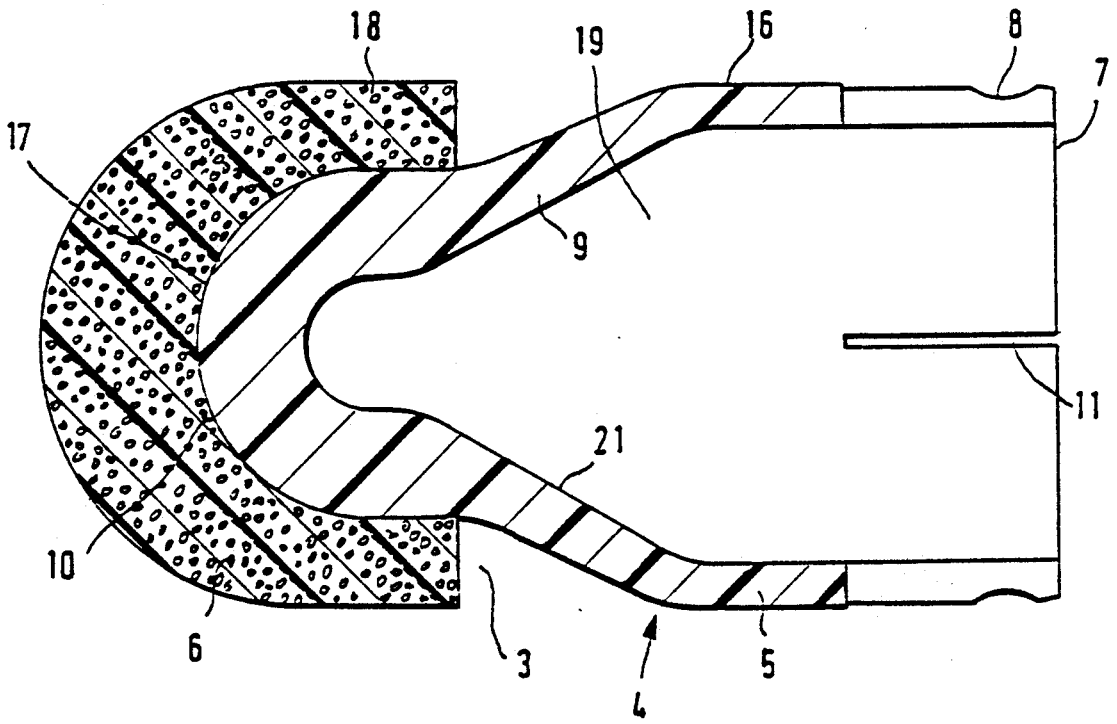
FIG. 1 is a sectional view of an embodiment of a cartridge case base of the cartridge; and, FIG. 2 is a sectional view of a complete cartridge for expelling fluids under pressure in the barrel of a weapon.

The cartridge case base 4 consists of a drive body 5 made of plastic, e.g., a polyamide, and the closing member 6 arranged axially on the head of the drive body 5 (see FIG. 1). The drive body 5 of the cartridge case base 4 is designed essentially as a hollow cylindrical body, whose rear, open end face 7 is directed toward the propellant charge chamber 2. In this rear area, the outer jacket surface has an annular groove 8 for fastening to the cartridge case 13 for transportation. In the front area, the drive body 5 is designed with a front side constricted area 9 which ends in a spherical or ball-like form 10 with a cylindrical guide projection. The diameter of the guide projection corresponds to the reduced internal diameter (not shown) of the muzzle area of the barrel. The closing member 6 made of a polyurethane foam is attached to the spherical end face 10.

Slots 11 distributed over the circumference, which permit radial movement of the end-face jacket surface, are provided in the jacket in the rear area. The jacket surface 16 of the drive body 5 is in a slightly pre-tensioned contact with the inner jacket surface 14 of the barrel 15 of the arm.

As is apparent from FIG. 2, the entire cartridge consists of the cartridge case base 4, which is inserted into the cartridge case 13. Toward the rear end, the cartridge case 13 contains the propellant charge chamber 2 with the necessary propellant charge 27. The closure in the cartridge case is formed by the igniting element 28. A closing member 6 is attached in a force-locking relationship to the front end face 17 of the cartridge case base 4 in the described manner. The entire cartridge 1 is located in the cartridge chamber 29 of the weapon housing 30 with the breech (not shown here). The barrel 24 is locked in the weapon housing 30 in a manner not shown in the drawing. A check valve 31, which is connected to a hydraulic pump 32 via a pipe 33, is arranged at the essentially radial inlet opening 26 in the barrel 24. Another pipe 34 is located between a fluid container 35 and the hydraulic pump 32.

The cartridge case base 4 thus permits the drive components, namely, the cartridge case 13 with the igniting device 28, with powdered propellant charge 27, and with the front closing member 6, and the fluid to be propelled, e.g., water, to be fed in and charged separately. The water being charged from the container 35 to the fluid chamber 3.

The driving components are introduced into the cartridge chamber 29 of the barrel 24 by the breech or a corresponding feeding device. The cartridge chamber 29 is closed and locked on the rear side by the breech (not shown here). The amount of fluid to be separated is pumped by a hydraulic pump 32 into the annular chamber 3 between the closing member 6 and the drive body 5 of the cartridge case base 4 through the inlet opening 26 of the barrel 24 via a check valve 31. The fluid pressure developing brings about axial separation of the closing member 6 from the drive body 5. The fluid flowing in under pressure pushes the closing member 6 in the barrel 15 in the forward direction toward the muzzle of the barrel, overcoming the external friction force. Under a slight pressure, the cylindrical part 18 of the closing member 6 is in a sealing contact with the inner jacket surface 14 of the barrel. Once the supply of fluid has been terminated, no more pressure is available for displacing the closing member 6. The closing member 6 stops and thus forms the front-end seal for the fluid in the barrel 24. The drive body 5 was held in position by the cartridge case 13 during the admission of the fluid, so that it forms the rearward seal for the fluid.

After this fluid supply process, the cartridge is ready for firing. On igniting the cartridge 1, a gas pressure develops in the interior 19 of the drive body 5, and this pressure acts directed radially toward the inner wall 21 of the drive body, as is indicated by the arrows 20. As a result, the drive body 5 of the cartridge case base 4 is propelled in the direction of the muzzle of the barrel, and during this movement, it pushes the fluid column located in front of the cartridge case base 4 toward the closing member 6, which is pressed out of the barrel 24. Due to the gas pressure as shown by arrow 20, the middle and rear sections of the drive body, which can be widened radially elastically, will at the same time come into a sealing contact with the inner wall 14 of the barrel 15.

The cartridge case base 4 is expelled at a very high speed of circa 1000 m/sec. The water or the fluid introduced is therefore propelled as a projectile with the cartridge case base 4 by the pressure of the burning propellant charge 27. If this so-called water hammer is used for tunneling in mining, this water column with the front closing member 6 is shot into boreholes in the core. Due to the very high pressure shock of several thousand bar, the rock within the core is disintegrated.

While a specific embodiment of the invention has been shown and described in detail t illustrate the application of the principles of the invention, it will be understood that the invention may be embodied otherwise without departing from such principles.

WHAT IS CLAIMED IS:

1. A cartridge for expelling fluids under pressure, comprising: a propellant charge chamber and a separating device arranged between said propellant charge chamber and a fluid chamber, said separating device forming a cartridge case base including a drive body and a closing member, said drive body conformed as a hollow cylindrical body of an elastically deformable material, said hollow cylindrical body being open toward the propellant charge chamber at a rear end, said drive body including a front end side constricted area extending from said hollow cylindrical body to a terminating substantially spherical end, said hollow cylindrical body, said constricted area and said substantially spherical end being formed integral, said substantially spherical end receiving an elastically deformable closing member.

2. A cartridge according to claim 1, wherein said closing member is formed of plastic.

3. A cartridge according to claim 1, wherein said closing member is formed of a polyurethane foam.

4. A cartridge according to claim 1, wherein said drive body includes an outer jacket surface which cooperates with said closing member in a barrel to form a fluid chamber, said fluid chamber having a volume which may be increased and which corresponds to an essentially radial inlet opening of the barrel.

5. A cartridge according to claim 4, wherein said drive body is axially separated from said closing member in the barrel by pressure source means providing fluid flowing into said fluid chamber.

6. A cartridge according to claim 1, wherein said drive body includes axially extending slots distributed over the circumference of a rear area of said hollow cylindrical body.

7. A cartridge for expelling fluids under pressure, comprising: charge means defining a propellant charge chamber; separating means for separating said propellant charge chamber from a fluid chamber, said separating means being connected to said propellant charge chamber to form a cartridge case base and including a drive body formed of elastically deformable material with a substantially cylindrical hollow shape with is opened toward the propellant charged chamber at a rear end, and with a front end constricted area which extends from said substantially cylindrical hollow shape to a terminating substantially hemispherical end, and a closing member received by said substantially hemispherical end.

8. A cartridge according to claim 7, wherein said closing member is formed of plastic.

9. A cartridge according to claim 8, wherein said closing member is made of a polyurethane foam.

10. A cartridge according to claim 7, wherein said drive body includes an outer jacket surface in contact with an inner surface, said outer jacket surface cooperating with said closing member and the inner surface of the barrel to form the fluid chamber, the fluid chamber having a volume which is increased by the addition of fluid from an essentially radial inlet opening in the barrel.

11. A cartridge according to claim 10, wherein said drive body is axially separated from said closing member in the barrel by pressure of fluid flowing into the fluid chamber.

12. A cartridge according to claim 7, wherein said drive body includes axially extending slots distributed over a circumference of a rear area of said hollow cylindrical body.

* * * * *